United States Patent [19]

Martinez

[11] Patent Number: 4,691,820

[45] Date of Patent: Sep. 8, 1987

[54] PACKAGE FOR HYDROPHILIC CONTACT LENS

[75] Inventor: Robert Martinez, Flemington, N.J.

[73] Assignee: Vistakon, Inc., Jacksonville, Fla.

[21] Appl. No.: 940,710

[22] Filed: Dec. 11, 1986

Related U.S. Application Data

[63] Continuation of Ser. No. 800,573, Nov. 18, 1985, abandoned.

[51] Int. Cl.[4] ..... B65D 81/24

[52] U.S. Cl. ..... 206/205; 206/5.1; 206/461; D9/415

[58] Field of Search ..... 206/205, 5.1, 461, 467, 206/470, 471, 484; D9/424–429, 415

[56] References Cited

U.S. PATENT DOCUMENTS

| | | | |
|---|---|---|---|
| D. 253,515 | 11/1979 | Meirhoefer | D9/415 |
| D. 282,819 | 3/1986 | Laurent et al. | D9/415 |
| 4,623,249 | 11/1986 | Grant | 206/5.1 |

*Primary Examiner*—Stephen Marcus
*Assistant Examiner*—David T. Fidei
*Attorney, Agent, or Firm*—Donal B. Tobin

[57] ABSTRACT

A molded blister package for storing and dispensing a hydrophilic contact lens comprises a base portion which includes a cavity surrounded by a outstanding flange, and a cover sheet sealed to the flange to enclose the cavity. A portion of the side wall of the cavity is inclined to form a ramp to the flange. The cover sheet may be stripped from the flange to expose the cavity and inclined side wall whereupon the lens is readily removed by sliding up and out of the cavity along the inclined surface.

12 Claims, 7 Drawing Figures

PACKAGE FOR HYDROPHILIC CONTACT LENS

This is a continuation, of application Ser. No. 800,573, filed 11/18/85, now abandoned.

FIELD OF INVENTION

This invention relates to blister packages, and more particularly, to a blister package for storing and dispensing hydrophilic contact lenses which are maintained in an aqueous solution.

BACKGROUND OF THE INVENTION

Soft, hydrophilic contact lenses are manufactured from hydrophilic polymeric materials such as copolymers of hydroxyethyl methacrylate, and may contain from 20 to 90 percent or more water, depending on polymer composition. Such lenses must be stored in a sterile aqueous solution, usually isotonic saline, to prevent dehydration and to maintain the lenses in a ready to wear condition.

Common practice has been for lens manufacturers to use a stoppered glass bottles as the storage and shipping container for each individual lens. The standard contact lens bottle is approximately 10 cc in volume, is sealed with a silicone stopper and provided with a metal foil overcap safety seal. Each bottle contains approximately 7 cc of saline and a single contact lens which is identified on the label of the bottle. When the lens is to be removed for fitting on a patient, the practitioner must first tear and remove the metal safety seal, then remove the stopper, and finally remove the lens with a plastic tweezer.

Packaging contact lenses in glass bottles is expensive due to the cost of bottles, stoppers and seals, and shipping is expensive due to the weight of the glass and saline. Bottles are also subject to breakage if accidentally dropped during handling, and removing the lens from the bottle with tweezers is inconvenient since the lens is nearly invisible when submerged in saline.

It is accordingly an object of the present invention to provide an improved package for storing, shipping and dispensing hydrophilic contact lenses. It is a further object of this invention to provide a lens package which allows for improved efficiencies in the lens manufacturing process. It is a yet further object of this invention to provide an inexpensive package which allows for convenient removal of the contact lens. These and other objects of this invention will be apparent from the ensuing description and claims.

SUMMARY OF INVENTION

The package of the present invention is a shaped blister package covered with a flexible sheet material which can be stripped from the package to gain access to the lens. The molded base or blister portion of the package includes a cavity for receiving the contact lens and saline solution, and an outward extending flange around the perimeter of the cavity to which the cover material is sealed. The cavity of the package is defined by a bottom surface and side walls extending between the bottom surface and the peripheral flange. A portion of the side wall is inclined away from the bottom surface to form a ramp or inclined surface between the bottom of the cavity and the flange. The cover material is sealed to the flange around the cavity by means which allow the cover to be readily stripped or peeled from the flange. The flange adjacent the inclined surface and the overlying cover material extend outward beyond the seal area to provide unsealed edges which may be gripped to facilitate removal of the cover.

The package according to the present invention is inexpensive, light in weight, and requires less saline for lens storage. The package is conveniently opened by stripping the cover from the flange to expose the cavity and the lens in a shallow bath of saline. The lens is conveniently removed by sliding the lens up the inclined surface using either tweezers or a finger.

The base portion of the package may be injection molded or thermoformed from any suitable thermoplastic sheet material such as polypropylene. The cover stock may be a laminate of polypropylene film and aluminum foil which can be heat sealed to the flange around the cavity of the package. Lens identification and other label information can be printed on the cover stock. Once the package is opened and sterility lost, the package is not amenable to reclosure.

DESCRIPTION OF EMBODIMENTS

Figure 1:
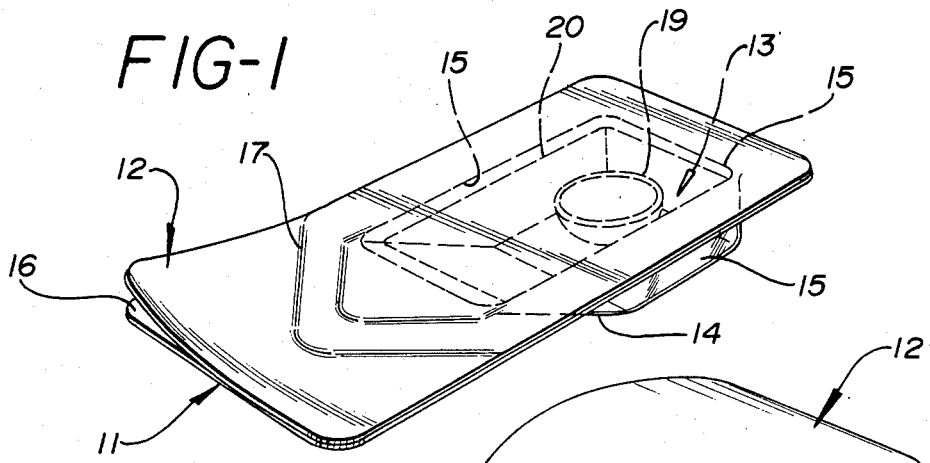
FIG. 1 is a phantom view in perspective of a package according to the present invention.

With reference to FIG. 1, there is illustrated a preferred embodiment of a package according to the present invention consisting of lower base portion 11 and cover member 12. The lower portion includes a cavity indicated generally as 13 which is formed by inclined side wall 14 and upstanding side walls 15. The cavity is surrounded by outward extending flange 16. Cover 12 is sealed to flange 16 around the opening of cavity 13 as indicated by seal line 17. Cavity 13 is sized to receive contact lens 19 and a sufficient quantity of saline 20 to completely submerge the lens.

Figure 2:
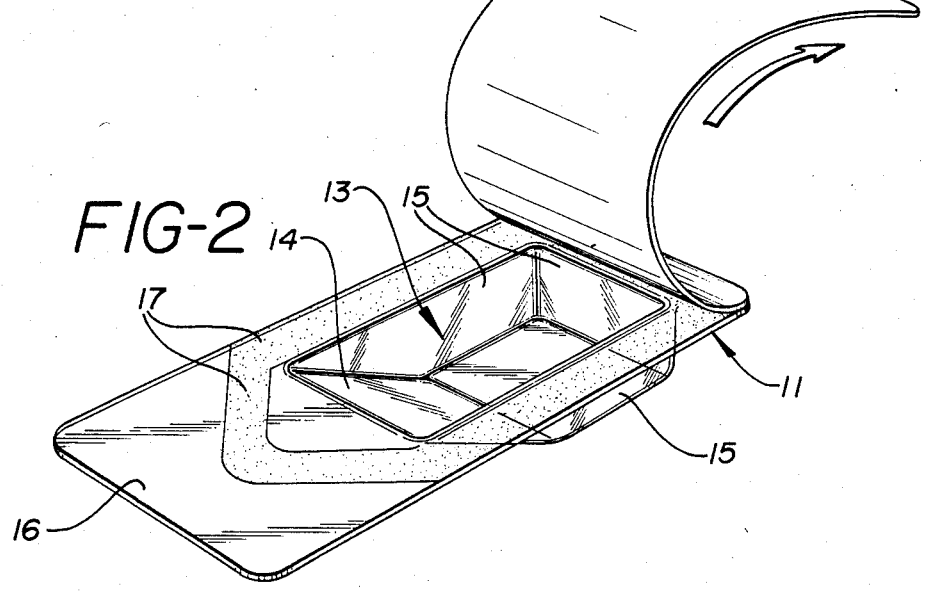
FIG. 2 is a perspective view of the package of FIG. 1 with the cover partially removed.

As illustrated in FIG. 1, that portion of flange 16 and cover 12 adjacent inclined side wall 14 extends well beyond the area of seal 17. The unsealed edges of the flange and cover thereby provide gripping means whereby the cover may be readily stripped from the flange to gain access to cavity 13 and the lens contained therein. An opened package with the cover member still secured along the rear edge of the flange is illustrated in FIG. 2. The seal line between inclined side wall 14 and the unsealed edges of the cover and flange is preferably chevron shaped as illustrated in FIGS. 1 and 2 for ease in opening the package since the chevron configuration allows for a more uniform stripping force to be applied, assuring that the package can be opened without spilling the contents.

Figure 3:
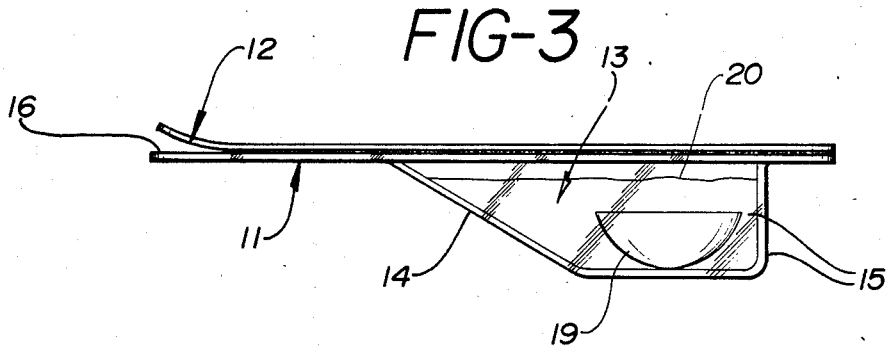
FIG. 3 is a side elevational plan view of the package of FIG. 1.

FIG. 3 is a side plan view which most clearly illustrates the slope of inclined surface 14. Preferably, surface 14 should form an obtuse angle of from about 130 to 160 degrees with the plane of the bottom surface of cavity 13, and most preferably from about 140 to 150 degrees. A slope within this range allows the lens to be readily removed from the cavity without unduly increasing the volumn of the cavity or the length of the seal line around the perimeter of the cavity. A typical contact lens has a diameter of from about 13 to 15 mm and a depth of from about 3 to 4 mm. A suitable cavity for such a lens is from 6 to 10 mm deep with a 20×20 mm bottom surface and an opening of about 20×30 mm. The outer dimension of such a package is approximately 3×6 cm.

Figure 4:
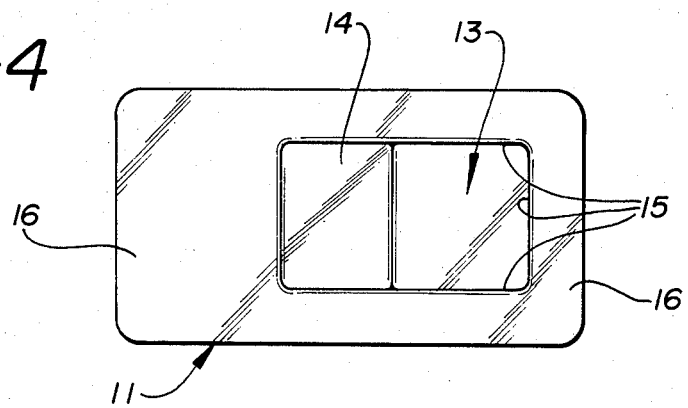
FIG. 4 is a top plan view of the package of FIG. 1 with the cover removed.
Figure 5:
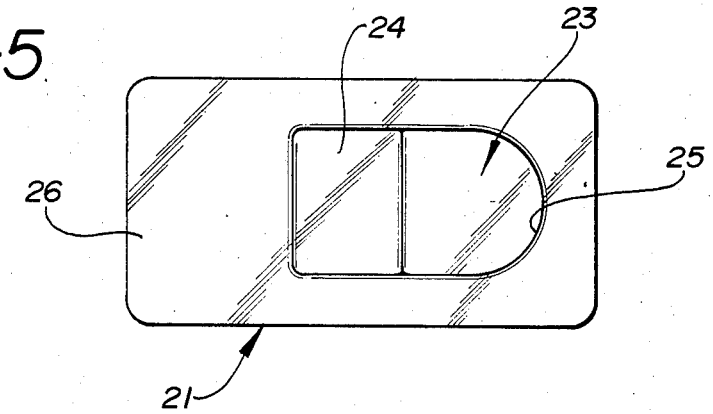
FIG. 5 is a top plan view of another embodiment of a package according to the present invention with the cover removed.
Figure 6:
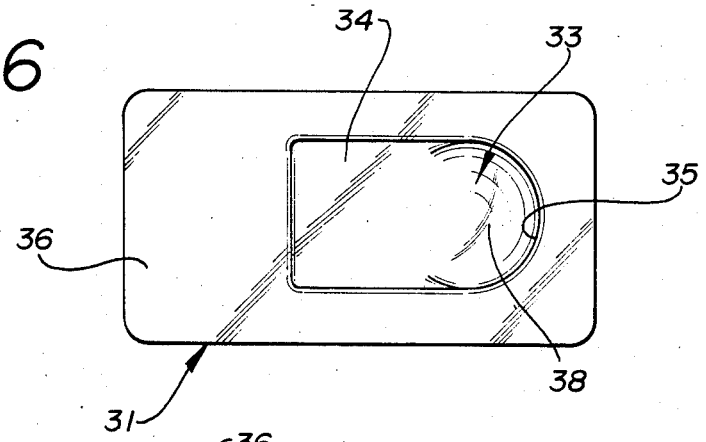
FIG. 6 is a top plan view of another embodiment of a package according to the present invention with the cover removed.
Figure 7:
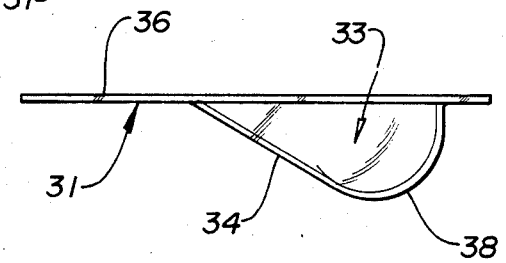
FIG. 7 is a side elevational view of the package of FIG. 6.

FIG. 4 is a top plan view of the package of FIG. 1 with cover 12 removed to more clearly illustrate the configuration of cavity 13. FIG. 5 is a top plan view of another embodiment of a package wherein cavity 23 surronded by flange 26 is defined by semicircular upstanding side wall 25 merging into inclined side wall 34. FIG. 6 illustrates a further embodiment of the present invention wherein the bottom surface 38 of cavity 33 is concave. The concave surface encourages the lens contained in the cavity to rest on the bottom surface with the edges of lens extending upward, thereby increasing the ease with which the lens may be located and brought up to flange 36 of the package. The inclined sidewall surface may likewise be flat or concave as desired.

The lower portion 12 of the package according to the present invention is preferably produced by thermoforming polypropylene sheet material having a thickness of about 0.8 mm. Polypropylene is preferred for its good thermoforming properties, its ability to withstand heat sterilization at about 120° C. with little or no shrinkage or distortion, and its ability to be heat sealed to cover stock material.

The cover stock is preferably an adhesive laminate of aluminum foil and polypropylene film which can be heat sealed to the base section of the package to provide an air tight seal, and yet be readily stripped from the package when the package is to be opened. The aluminum foil is preferably coated or lacquered on the opposite surface to provide label identification and a receptive surface for later imprinting lens parameters such as diameter, power, and base curve.

The packages of the present invention may be constructed of materials other than those identified herein although materials as identified provide good results. Packages constructed of materials such as polyethylene which are less heat resistant than polypropylene and not suitable for heat sterilization may be radiation or gas sterilized, optionally with aseptic assembly techniques.

In addition to withstanding sterilization temperatures of about 120° C., the sealed packages for hydrophilic contact lenses must be impermeable to bacteria to preserve sterility, have a negligible moisture vapor transmission rate to avoid loss of water, and be able to maintain the lens in its original condition for the stated shelf life of the product, usually 2 to 4 years. The package materials and the packaging procedures must be selected accordingly.

While the packages of the present invention as illustrated herein have been generally rectangular in shape with a rectangular or elongated cavity, it will be apparent that many other sizes and shapes may be utilized without departing from the scope of the present invention. The packages of the present invention are characterized by a storage cavity having an inclined wall or ramp extending from the bottom of the cavity to a peripheral outstanding flange, and a removable cover sheet sealed to said flange around the perimeter of said cavity. Materials, methods of fabrication and package configuration may vary according to the specific needs and desires of the practicioner.

I claim:

1. A package for a hydrophilic contact lens maintained in a sterile aqueous solution comprising:

a molded base having a cavity for containing said contact lens and a flange extending outwardly about the periphery of said cavity, said cavity being defined by a bottom surface and side wall surfaces extending between said bottom surface and said flange, a portion of said side wall surface being inclined away from said bottom surface at an angle of from about 130 to 160 degrees, said inclined side wall surface forming a ramp between the bottom of the cavity and said flange, and a flexible cover sheet releasably sealed to said flange around the perimeter of said cavity, said cover sheet and said flange adjacent the edge of said inclined side wall surface extending outwardly to beyond the area of said seal, the unsealed edges of said cover sheet and said flange comprising gripping means for separating said cover sheet from said flange to expose said inclined side wall and said cavity;

said package being impermeable to bacteria to preserve sterility, said package having negligible moisture vapor transmission rate to avoid loss of water; and, said package being sterilizable.

2. The package of claim 1 wherein the bottom surface of said cavity is a smooth planar surface.

3. The package of claim 1 wherein the inclined side wall surface is a smooth planar surface.

4. The package of claim 1 wherein the bottom surface of said cavity is concave.

5. The package of claim 1 wherein the inclined side wall surface is concave.

6. The package of claim 1 wherein said molded base is a thermoformable polypropylene polymer.

7. The package of claim 1 wherein said cover sheet is heat sealed to said flange.

8. The package of claim 7 wherein said cover sheet is an adhesive laminate of aluminum foil and polypropylene film.

9. The package of claim 7 wherein said heat seal has a chevron configuration adjacent said unsealed edges of said cover sheet and said flange.

10. The package of claim 1 wherein said cavity is rectangular and is defined by three upstanding side walls and one inclined side wall.

11. The package of claim 1 wherein said cavity is defined by a semicircular upstanding side wall merging into an inclined side wall.

12. The package of claim 1 wherein said negligible moisture vapor transmission rate is capable of maintaining said lens in its original condition for shelf-life period of up to four years.

* * * * *